US006377767B1

(12) United States Patent
Fukushima et al.

(10) Patent No.: US 6,377,767 B1
(45) Date of Patent: Apr. 23, 2002

(54) TONER AGITATING AND TRANSPORTING MEMBER OF A TONER CARTRIDGE AND DEVELOPING DEVICE

(75) Inventors: Koji Fukushima; Yoshihiro Maekawa; Kiyoshi Yamaguchi; Yuusaku Shibuya; Tomomitsu Fukuda; Kazuya Furuta; Masako Kojima, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/655,315

(22) Filed: Sep. 5, 2000

(30) Foreign Application Priority Data

Dec. 24, 1999 (JP) ..... 11-367584

(51) Int. Cl.[7] ..... G03G 15/08
(52) U.S. Cl. ..... 399/263
(58) Field of Search ..... 399/254, 256, 399/262, 263; 430/109

(56) References Cited

U.S. PATENT DOCUMENTS 5,581,337 A * 12/1996 Suzuki ..... 399/254

FOREIGN PATENT DOCUMENTS

JP 11-160987 6/1999

* cited by examiner

*Primary Examiner*—William J. Royer
(74) *Attorney, Agent, or Firm*—Oliff & Berridge, PLC

(57) ABSTRACT

The invention is to provide a toner, a toner cartridge and a developing device using the same in that an excellent image without a defect on the image is obtained in a long period of time, and stable agitation and transportation can be conducted. In a toner cartridge containing a toner containing at least a binder resin, a colorant and wax, inside the toner cartridge, and a toner agitating and transporting member for supplying the toner under agitation and transportation, the toner contains the wax in an amount of from 3 to 10% by weight and has a mean particle diameter of from 3 to 10 $\mu$m, and the toner agitating and transporting member is arranged as rotatably inside the toner cartridge to form a distance of from 0.5 to 3.0 mm between the member and an inner wall of a main body of the toner cartridge.

20 Claims, 4 Drawing Sheets

TONER AGITATING AND TRANSPORTING MEMBER OF A TONER CARTRIDGE AND DEVELOPING DEVICE

FIELD OF THE INVENTION

The present invention relates to a toner, a toner cartridge and a developing device using the same used in an image forming apparatus utilizing an electrophotographic method or an electrostatic recording method, such as a duplicator, a printer and a facsimile.

BACKGROUND OF THE INVENTION

In the image forming apparatus, such as a duplicator and a printer, an electrophotographic method or an electrostatic recording method based on the Carlson process has been used. In the image forming apparatus using an electrophotographic method or an electrostatic recording method, after an electrostatic latent image formed on a photoreceptor by an optical process is developed by a developing step, the image is transferred to a recording medium, such as recording paper, in a transferring step, and then it is fixed to the recording medium, such as recording paper, in a fixing step generally by heat and pressure, so as to form an image. In order to repeatedly use the photoreceptor for the image formation, a cleaning device for removing a toner remaining on the photoreceptor after completion of transition is arranged.

The developing method used for the development of the electrostatic latent image includes an one-component developing method using only a toner and a two-component developing method using a toner and a carrier. In the developer for the two-component developing method, since the toner is charged by friction through agitating the toner and the carrier, the charging amount by friction of the toner can be controlled to a certain extent by selecting the characteristics of the carrier and the agitation conditions, and therefore it is excellent since the image quality is highly reliable.

In order to produce a toner used in the electrophotographic process, such a production process using a pulverization and classification method is generally employed in that a colorant, a charge controlling agent and a releasing agent are added to a synthetic resin, such as a polyester resin, a styrene-acrylic resin or an epoxy resin, and fused and kneaded therewith to be uniformly dispersed therein. The mixture is then pulverized to have a prescribed particle size, and excess coarse particles and fine particles are removed by a classifying apparatus. It is being demanded to further reduce the particle size of a toner along with the demand of further increasing the image quality. It is also demanded, according to the demand of energy saving, to lower the glass transition point and the softening point of the resin used in the toner for realizing fixing at a lower temperature.

In a color toner used in a full color duplicator and a full color printer, it is necessary that multicolor toners are sufficiently mixed on the fixing step, and the color reproducibility and the transparency of an image for OHP are important. It is generally desired that color toner, in comparison to black toner, is formed with a resin of a sharp melting property having a low molecular weight that can be instantaneously fused and mixed for improving color mixing property.

Wax having a high crystallinity and a relatively high melting point, such as polyethylene and polypropylene, has been used in black toner for obtaining an offset resistance on fixing, but it deteriorates the transparency of an OHP image in the color toner for a full color image. Therefore, the color toner for a full color image does not contain wax, but in order to prevent offset, a surface of a heat fixing roller is formed with silicone rubber or a fluorine resin having a good releasing property to the toner, and a releasing liquid, such as a silicone oil, is further supplied to the surface. Although this method is greatly effective to prevent the offset phenomenon of the toner, there is a problem in that an apparatus is required for supplying an offset preventing liquid to the surface of the heat fixing roller. It is opposite to the trend of decreasing the size and the weight of the apparatus for forming an image, and it sometimes causes another problem in that the offset preventing liquid is heated and evaporated to form an offensive odor and contaminates the inside of the apparatus.

According to the circumstances, a full color toner is greatly demanded in that the multicolor toners are sufficiently mixed to ensure the offset resistance in the fixing step, the color reproducibility and the transparency of an OHP image even though an offset preventing liquid is not used but wax is used. Thus, such a toner having a small particle size is being demanded that contains wax having a low melting point by the pulverization and classification method, and is formed with a resin of a sharp melting property and a colorant.

The toner is forcedly agitated and transported from a toner cartridge to develop an electrostatic latent image on a photoreceptor, and after transferring the resulting toner image to a recording medium, the toner image is fixed to the recording medium. In this process, it is necessary to use an agitating and transporting member, such as an agitator and an auger, for forcedly agitating and transporting the toner.

However, in the case where the toner mentioned in the foregoing is subjected to a repeated agitation and transportation test on the toner cartridge having the agitating and transporting member, the toner is liable to be deformed in comparison to the conventional black and white toner and the color toner containing no wax, and the toner contains a relatively large amount of toner particles having a small diameter, which have relatively large attaching property. Thus, the toner receives mechanical stress by friction of the toner and a contacting part, such as an inner wall, and accumulation of the toner on the concave parts, whereby aggregates of the toner are formed. It is also considered that the part where the wax is exposed on the surface of the toner is the cause of the formation of aggregates of the toner. When the aggregates of the toner are developed, a problem is caused by forming defects on an image.

SUMMARY OF THE INVENTION

The invention has been developed to solve the problems associated with the conventional techniques and to provide a toner, a toner cartridge and a developing apparatus using the same realizing stable agitation and transportation of a toner, by which an excellent image having no defect can be obtained for a long period of time.

The invention relates to, as a first aspect, a toner cartridge comprising a toner and a toner agitating and transporting member for supplying the toner under agitation and transportation from inside the toner cartridge, the toner having a binder resin, a colorant and a wax, the wax is in an amount of from 1 to 15% by weight of the toner and the toner having a mean particle diameter of from 3to 10 $\mu$m, and the toner agitating and transporting member being arranged as rotatably inside the toner cartridge to form a distance of from 0.5 to 3.0 mm between the member and an inner wall of a main body of the toner cartridge.

In the first aspect of the invention, it is preferred that the toner further contains inorganic fine particles in an amount of from 1 to 10% by weight.

The invention also relates to, as a second aspect, a developing device comprising a toner and a toner agitating and transporting member and a developer holding member for developing an electrostatic latent image by the toner on the surface of the developer holding member, the toner having a binder resin, a colorant and a wax, the wax is in an amount of from 3 to 10% by weight and the toner having a mean particle diameter of from 3 to 10 $\mu$m, the toner agitating and transporting member transporting the toner to a developer holding member, and the toner agitating and transporting member being arranged as rotatably inside the main body of the developing device to form a distance of from 0.5 to 3.0 mm between the member and an inner wall of the developing device.

In the second aspect of the invention, it is preferred that the toner further contains inorganic fine particles in an amount of from 1 to 10% by weight.

The invention also relates to a process for forming an image employing the developing device.

BRIEF DESCRIPTION OF THE DRAWINGS

Preferred embodiments of the invention will be described in detail based on the following figures, wherein.

DESCRIPTION OF THE PREFERRED EMBODIMENTS

Figure 1:
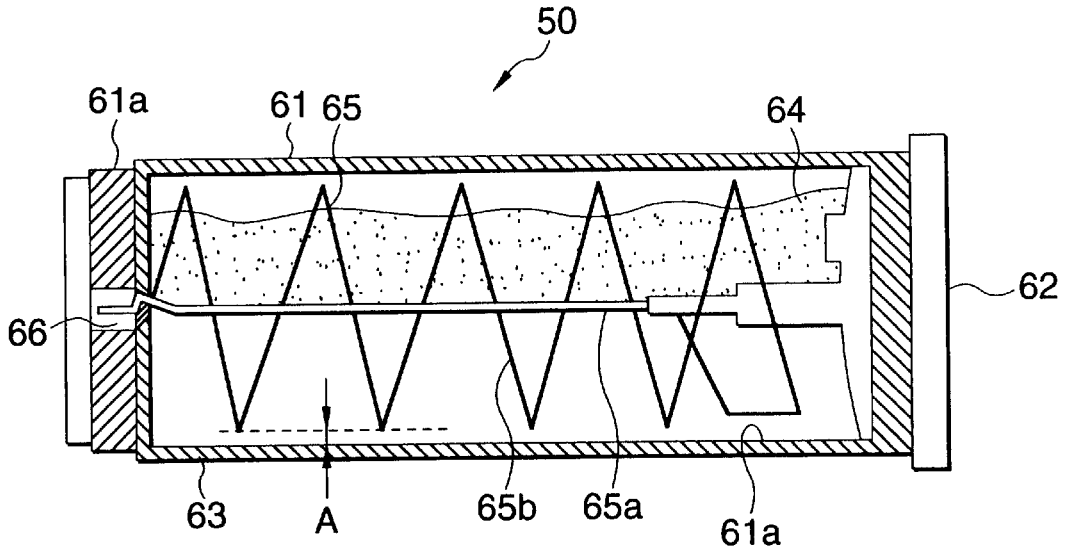
FIG. 1 is a cross sectional constitutional view showing a developer cartridge according to the first embodiment of the invention.

As a result of earnest investigations for a toner, a toner cartridge and a developing device made by the inventors for solving the problems associated with the conventional techniques, the problems have been solved by employing the aspects of the invention described in the foregoing.

In the toner, the toner cartridge and the developing device according to the invention, the toner contains wax in an amount of from 3 to 10% by weight and a mean particle diameter of from 3 to 10 $\mu$m, and the toner may further contain inorganic fine particles in an amount of from 1 to 10% by weight.

The toner cartridge of the invention comprising a toner and a toner agitating and transporting member for supplying the toner under agitation and transportation from inside the toner cartridge, the toner having a binder resin, a colorant and a wax, the wax is in an amount of from 1 to 15% by weight of the toner and the toner having a mean particle diameter of from 3 to 10 $\mu$m, and the toner agitating and transporting member being arranged as freely rotatably inside the toner cartridge to form a distance of from 0.5 to 3.0 mm between the member and an inner wall of a main body of the toner cartridge.

The developing device of the invention comprising a toner and a toner agitating and transporting member and a developer holding member for developing an electrostatic latent image by the toner on the surface of the developer holding member, the toner having a binder resin, a colorant and a wax, the wax is in an amount of from 3 to 10% by weight and the toner having a mean particle diameter of from 3 to 10 $\mu$m, the toner agitating and transporting member transporting the toner to a developer holding member, and the toner agitating and transporting member being arranged as freely rotatably inside the main body of the developing device to form a distance of from 0.5 to 3.0 mm between the member and an inner wall of the developing device.

In the case where the test is conducted where the toner is repeatedly agitated and transported by using a toner agitating and transporting member, such as an agitator and an auger, inside the toner cartridge by employing the toner, the toner cartridge and the developing device, it has been found that even when the attaching property is relatively increased by the toner particles having a small particle diameter, the mechanical stress applied to the toner is small, and thus aggregates of the toner are difficult to be formed, whereby defects on the resulting image can be decreased.

When the distance between the toner agitating and transporting member, such as an agitator and an auger, and the inner wall is less than 0.5 mm, there are cases where the toner agitating and transporting member is in contact and friction with the inner wall of the toner cartridge or the main body of the developing device due to vibration in driving. As a result, the toner receives mechanical stress to form aggregates of the toner, whereby defects are formed on the resulting image by the aggregates of the toner. When the distance between the toner agitating and transporting member, such as an agitator and an auger, and the inner wall is more than 3.0 mm, agitation and transportation of the toner, which is the intended purpose, becomes insufficient.

The agitator as the toner agitating and transporting member herein is generally formed with a metallic material, such as a stainless steel wire, which is worked into a spiral shape for agitation and transportation of the toner. The auger herein is generally formed with a synthetic resin, such as ABS, PS and POM, or a metallic material, such as stainless steel.

As a material for forming a main body of the cartridge and a main body of the developing device, various synthetic resins can be used, and in recent years, ABS, PS and POM as the synthetic resin are preferably employed.

When the toner containing inorganic fine particles in an amount of from 1 to 10% by weight is used in the toner cartridge or the developing device, it becomes tough against a mechanical load in comparison to a color toner containing wax, and toner aggregates are difficult to be formed, whereby defects on the resulting image due to the toner aggregates can be reduced.

Examples of the inorganic fine particles used in the toner of the invention include inorganic oxide fine particles, such as $SiO_2$, $TiO_2$, $Al_2O_3$, $Fe_2O_3$, MnO, ZnO, MgO, CaO, $K_2O$, $Na_2O$, $SnO_2$, $ZrO_2$, $CaO.SnO_2$, $K_2O.(TiO_2)_n$.

When the amount of the inorganic fine particles is less than 1% by weight, it is not effective for preventing the formation of the toner aggregates. When it exceeds 10% by weight, the wax is difficult to ooze on the surface of the toner, so as to deteriorate the fixing property.

When a concave part of a supporting part of the toner agitating and transporting member, such as an agitator and an auger, is filled with a curing resin, such as Sealant (a trade name), to be sealed and cured, accumulation of the toner on the concave part is reduced to lower the mechanical stress on the toner, whereby the toner aggregates are difficult to be formed, and defects on the resulting image due to the toner aggregates can be reduced.

It is demanded to decrease the particle diameter of a toner for increasing the image quality in recent years, and the average particle diameter of the toner is preferably from 3 to 10 $\mu$m. When it is less than 3 $\mu$m, the electrostatic attaching force is increased relative to the force of gravity, and it becomes difficult to be handled as powder.

In the particle size distribution of the toner, when the amount of toner on the side of a smaller particle size is increased, the toner aggregates are liable to be formed, and therefore, in the case where the average particle diameter of the toner is about 7 $\mu$m, such particle size distribution is preferred that the amount of toner particles of 4 $\mu$m is 30% by number or less.

In full color duplicators and printers recently available, there is a problem in that an apparatus is required for supplying an offset preventing liquid to the surface of the heat fixing roller for preventing contamination and offset of the roll on the fixing step. It is opposite to the trend of decreasing the size and the weight, and it sometimes causes another problem in that the offset preventing liquid is heated and evaporated to form offensive odors and contaminates the inside of the apparatus.

Therefore, it is necessary that the toner contains wax in order to obtain a good fixing property under the conditions where the offset preventing liquid is substantially not used.

The wax has an endothermic starting temperature of 40° C. or more in the DSC curve measured by a differential scanning calorimeter, which is preferably 50° C. or more. When it is lower than 40° C., aggregation of the toner is caused in the duplicator or the toner bottle. The endothermic starting temperature is influenced by the component of the wax having a smaller molecular weight in the molecular weight distribution of the wax, the structure thereof and the amount and species of the polar group contained therein. In general, when the molecular weight is increased, the endothermic starting temperature and a melting point are increased together. However, the low melting temperature and the low viscosity inherent in the wax are deteriorated by simply increasing the molecular weight. Thus, it is effective to selectively remove the component having a lower molecular weight from the molecular weight distribution of the wax. Examples of the method therefore include molecular distillation, solvent fractionation and gas chromatography.

It is preferred that the wax is melted at a temperature of from 70 to 120° C. and has a melt viscosity of from 1 to 200 centipoise at 120° C., and more preferably has a melt viscosity of from 1 to 100 centipoise. When the wax is melted at a temperature of less than 70° C., the temperature change of the wax is too low, whereby the blocking resistance may be inferior and the developing property may be deteriorated when the temperature inside the duplicator is increased. When it exceeds 120° C., the temperature change of the wax is too high, whereby the fixing is necessarily conducted at a high temperature, which is not desired from the standpoint of energy saving. When the melt viscosity is more than 200 centipoise, the wax is difficult to ooze from the toner, whereby the fixing peeling property becomes insufficient.

The addition amount of the wax in the toner is from 3 to 10% by weight. When the amount of the wax is less than 3% by weight, sufficient fixing latitude (i.e., the temperature range of the fixing roll where the fixing can be conducted without offset of the toner) cannot be obtained. When it exceeds 10% by weight, the powder fluidity of the toner is deteriorated, and the toner aggregates are liable to be formed. Furthermore, the wax is inferior in transparency in comparison to the binder resin, and thus there are problems in that the transparency of an image for OHP is decreased to form a darkish projected image.

Examples of the wax used in the invention include paraffin wax and a derivative thereof, montan wax and a derivative thereof, microcrystalline wax and a derivative thereof, Fischer-Tropsch wax and a derivative thereof, and polyolefin wax and a derivative thereof. Examples of the derivative include an oxide, and a polymer or a graft modified product with a vinyl monomer. An alcohol, an aliphatic acid, vegetable wax, animal wax, mineral wax, ester wax and an acid amide may also be used.

It is necessary that the surface of the fixing roll is formed with a material that is excellent in releasing property to the toner, such as silicone rubber and a fluorine resin, for not attaching the toner onto the surface of fixing roll.

The toner used in the invention contains at least a known colorant and a known binder resin.

Examples of the binder resin include a homopolymer and a copolymer of a styrene compound, such as styrene and chlorostyrene, a monoolefin, such as ethylene, propylene, butylene and isoprene, a vinyl ester, such as vinyl acetate, vinyl propionate, vinyl benzoate and vinyl acetate, an a-methylene aliphatic monocarboxylic acid ester, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, a vinyl ether, such as vinyl methyl ether, vinyl ethyl ether and vinyl butyl ether, and a vinyl ketone, such as vinyl methyl ketone, vinyl hexyl ketone and vinyl isopropenyl ketone. Representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Further examples thereof include polyester, polyurethane, an epoxy resin, a silicone resin, polyamide, modified rosin, paraffin and wax. Among these, it is effective when the binder resin is polyester. For example, a linear polyester resin formed with a polycondensation product containing, as main monomer components, bisphenol A and a polyvalent aromatic carboxylic acid is preferably used.

The polyester resin used in the invention is synthesized by polycondensation of a polyol component and a polycarboxylic acid component. Examples of the polyol component include ethylene glycol, propylene glycol, 1,3-butanediol, 1,4-butanediol,2,3-butanediol, diethyleneglycol, triethylene glycol, 1,5-butanediol, 1,6-hexanediol, neopentyl glycol, cyclohexane dimethanol, hydrogenated bisphenol A, a bisphenol A-ethylene oxide adduct and a bisphenol A-propylene oxide adduct. Examples of the polycarboxylic acid component include maleic acid, fumaric acid, phthalic acid, isophthalic acid, terephthalic acid, succinic acid, dodecenylsuccinic acid, trimellitic acid, pyromellitic acid, cyclohexane tricarboxylic acid, 2,5,7-naphthalene tricarboxylic acid, 1,2,4-naphthalene tricarboxylic acid, 1,2,5-hexane tricarboxylic acid, 1,3-dicarboxyl-2-methylenecarboxypropane tetramethylene carboxylic acid, and an anhydride thereof.

A resin having a softening point of from 90 to 150° C., a glass transition point of from 55 to 75° C., a number average molecular weight of from 2,000 to 6,000, a weight average molecular weight of from 8,000 to 150,000, an acid value of from 5 to 30 and a hydroxyl value of from 5 to 40 is preferably used.

Representative examples of the colorant of the toner particles include carbon black, nigrosin, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red48:1, C.I. Pigment Red 122, C.I. Pigment Red 57:1, C.I. Pigment Yellow 97, C.I. Pigment Yellow 12, C.I. Pigment Blue 15:1 and C.I. Pigment Blue 15:3.

The toner used in the invention may further contain, in addition to the binder resin, the colorant, such as carbon black, the wax and the inorganic fine particles, at least one charge controlling agent for adjusting the charge as an internal additive. The toner may contain a petroleum resin for satisfying the pulverization property and the thermal storage property of the toner. The petroleum resin is synthesized from a diolefin or a monoolefin contained in a decomposed oil fraction formed as a by-product from an ethylene plant for producing ethylene and propylene by steam cracking of petroleum. Furthermore, in order to further improve the long term storage property, the fluidity, the developing property and the transferring property of the toner, inorganic powder and resin powder may be added singly or in combination to the surface of the toner used in the invention. Examples of the inorganic powder include carbon black, silica, alumina, titania and zinc oxide, and examples of the resin powder include spherical particles of PMMA, nylon, melamine, benzoguanamine and a fluorine resin, and irregular powder of vinylidene chloride and a metallic salt of fatty acid. In the case where they are added to the surface, the addition amount thereof is preferably from 0.2 to 4% by weight, and more preferably from 0.5 to 3% by weight.

In the toner used in the invention, the addition of the internal additives into the interior of the toner is conducted by a kneading treatment. The kneading treatment can be conducted by using various heat kneading apparatuses. As the heat kneading apparatuses, a three-roll type, a single-axis screw type, two-axes screw type and a Banbury mixer type.

The production process of the toner used in the invention is not limited. The pulverization of the kneaded product can be conducted by Micronizer, Ulmax, Jet-o-mizer, KTM (Krypton) and Turbomill. I-type Jet-Mill may also be employed. The classification can be conducted by Elbow Jet using the Coanda effect and a wind power type. The toner may be subjected to a subsequent treatment for changing the shape by using Hybridization System (produced by Nara Machinary Co., Ltd.), Mechanofusion System (produced by Hosokawa Micron Corp.) and Criptron system (produced by Kawasaki Heavy Industries, Ltd.) for changing the shape to spherical by hot air.

As a carrier, known carriers can be used without particular limitation, and examples thereof include an iron series carrier, a ferrite series carrier and a surface-coated ferrite carrier.

Embodiments of the invention will be described with reference to the drawings.

First Embodiment

Figure 3:
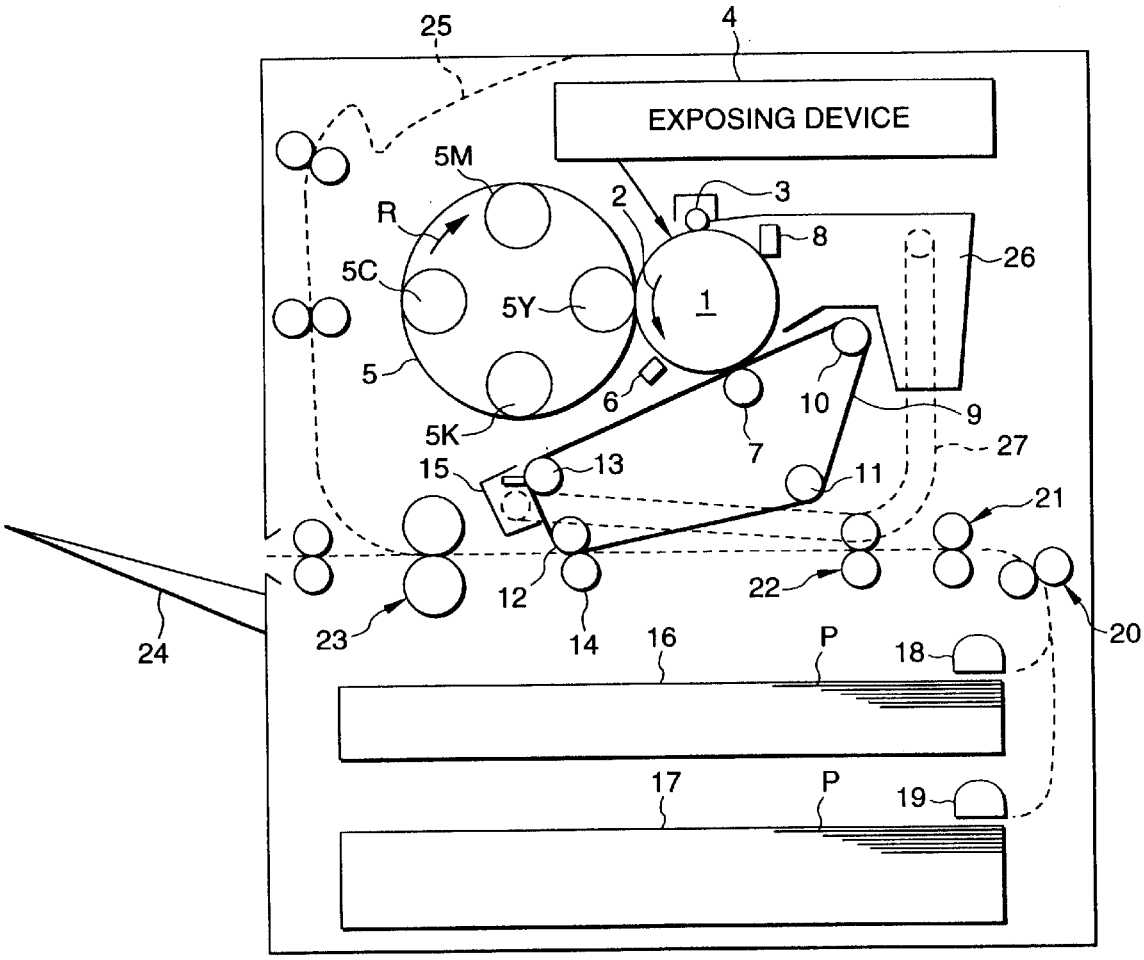
FIG. 3 is a cross sectional constitutional view showing a digital color printer as an apparatus for forming an image, to which the toner, the developer cartridge and the developing device according to the first embodiment of the invention are applied.

FIG. 3 shows a full color printer apparatus as an apparatus for forming an image, to which the toner, the toner cartridge and the developing device according to the first embodiment of the invention are applied.

In FIG. 3, numeral 1 denotes a photoreceptor drum as an image holding member, and the photoreceptor drum 1 is driven as rotated at a prescribed rate in the direction of the arrow 2 by a driving unit not shown in the figure. The surface of the photoreceptor drum 1 is uniformly charged at a prescribed potential by a charging roll 3, and is then exposed to images of four colors of yellow (Y), magenta (M), cyan (C) and black (K) one by one, in the case where a full color image is formed, by an exposing device 4 containing an ROS (raster output scanner), so as to form electrostatic latent images corresponding to the respective colors. The electrostatic latent images corresponding to the prescribed colors formed on the surface of the photoreceptor drum 1 are developed by developing units 5Y, 5M, 5C and 5K of the rotary developing device 5, so as to form toner images of the respective colors. The rotary developing device 5 contains the developing units 5Y, 5M, 5C and 5K for the four colors of yellow (Y), magenta (M), cyan (C) and black (K) for developing a full color image, and the developing units 5Y, 5M, 5C and 5K respectively develop the latent images on the photoreceptor drum 1 with toners of yellow, magenta, cyan and black. Upon developing with the toners of the respective colors, the rotary developing device 5 is rotated in the direction of the arrow R by a motor not shown in the figure, and the developing units 5Y, 5M, 5C and 5K of the respective colors are positioned at a developing position facing the photoreceptor drum 1. In the process controlling mode, a test chart is formed on the photoreceptor drum 1, the density of the test chart is detected by a density sensor 6. The toner images of the respective colors developed on the photoreceptor drum 1 are transferred one by one to an intermediate transfer belt 9 as an intermediate transferring material by a primary transfer roll 7, so as to superimpose the toner images of the four colors. The intermediate transfer belt 9 is rotatable by a driving roll 10, an idling roll 11, a backup roll 12 and an idling roll 13. The driving roll 10 is driven by a driving motor not shown in the figure that is excellent in constant driving rate, so as to drive rotatably the intermediate transfer belt 9 at a prescribed rate.

The toner images of the four colors transferred as overlapping each other on the intermediate transfer belt 9 are transferred at once to recording paper P as a recording medium by a secondary transfer roll 14, which is in contact under pressure with the backup roll 12 through the intermediate transfer belt 9. The recording paper P is supplied from one of paper supplying cassettes 16 and 17 provided at a lower part of the main body of the printer apparatus by a paper supplying roll 18 or 19, and the recording paper P is transported to a pair of resist rolls 22 through plural transporting rolls 20 and 21, and then once stopped. Thereafter, the recording paper P is transported by the pair of resist rolls 22 which starts rotating in synchronism with a toner image transferred on the intermediate transfer belt 9 to the secondary transfer part where the backup roll 12 is in contact under pressure with the secondary transfer roll 14 through the intermediate transfer belt 9. After the toner images of the four colors are transferred at once from the intermediate transfer belt 9 to the recording paper P at the secondary transfer part, the recording paper P is subjected to a fixing treatment with heat and pressure by a fixing device 23, and is discharged to a discharge tray 24 at the side surface of the main body of the apparatus or a discharge tray 25 on an upper part of the main body of the apparatus by switching with a switching gate not shown in the figure.

The toner remaining on the photoreceptor drum 1 after completion of the transferring step of the toner images is removed by a cleaning device 8 having a blade, and the photoreceptor drum 1 is prepared for the next image formation process. The intermediate transfer belt 9 after completion of the transferring step of the toner images is subjected to removal of the remaining toner by a belt cleaner 15 facing the idling roll 13 and is prepared for the next image formation process.

The waste toner scraped from the photoreceptor drum 1 and the intermediate transfer belt 9 by the cleaning device 8 and the belt cleaner 15 is recovered in the waste toner recovering container 26. In particular, the waste toner recovered from the belt cleaner 15 is transported in a transporting tube 27 by a transporting unit containing an auger and a transporting screw to the waste toner recovering container 26.

Figure 4:
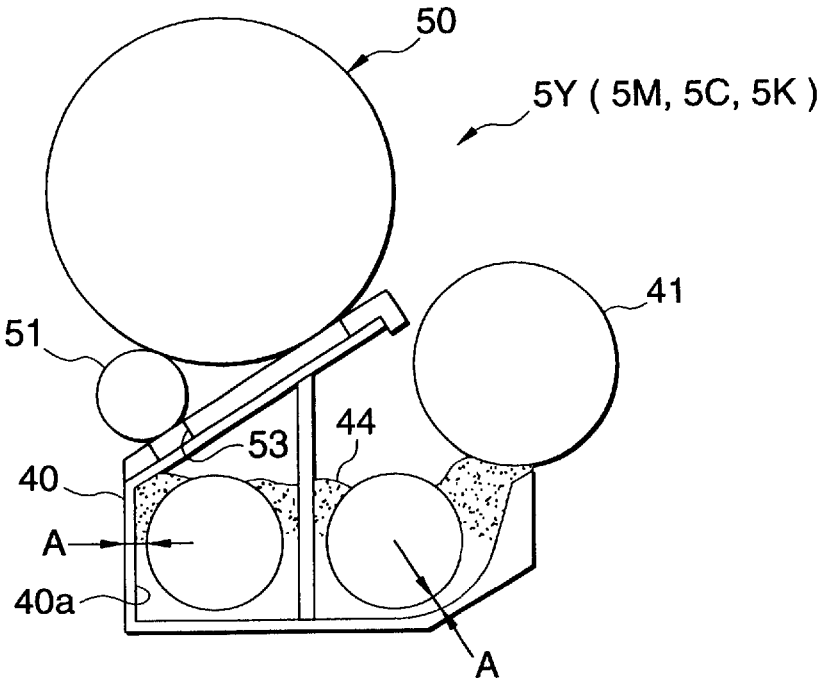
FIG. 4 is a cross sectional constitutional view showing a developing unit according to the first embodiment of the invention.

FIG. 4 is a cross sectional view showing one of the developing units of the rotary developing device 5.

The rotary developing device 5, as shown in FIG. 3, has a rotating body driven clockwise, and developing units 5Y, 5M, 5C and 5K as four developing units of yellow (Y), magenta (M), cyan (C) and black (K) are installed in the rotary body by an installing unit not shown in the figure.

The developing units 5Y, 5M, 5C and 5K have the same constitution, and the yellow (Y) developing unit 5Y is described herein. The yellow (Y) developing unit 5Y is constituted, as roughly classified, with a developing unit main body 40 and a developer cartridge 50 as shown in FIG. 4.

Figure 5:
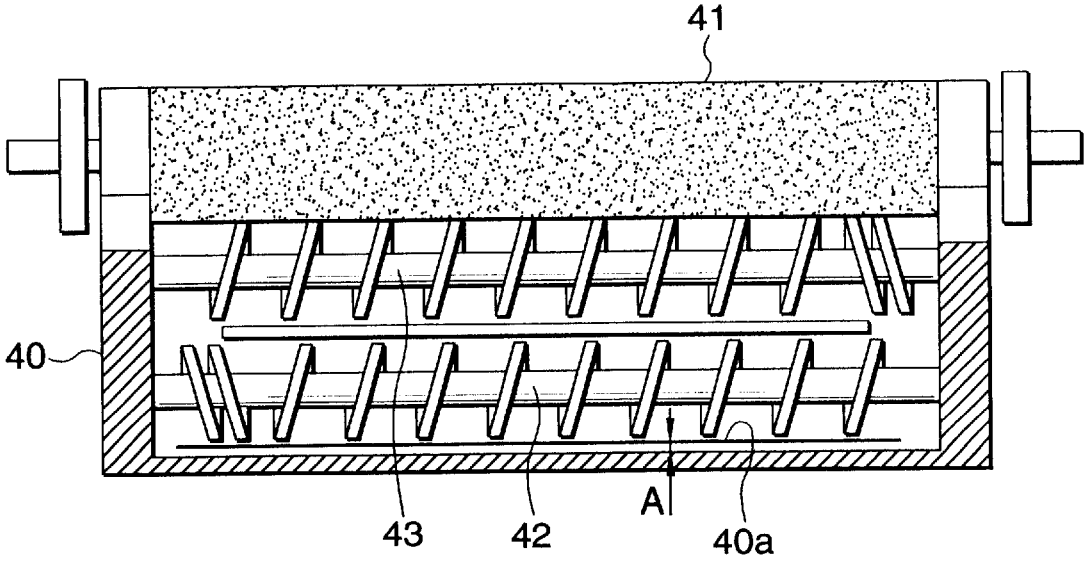
FIG. 5 is a cross sectional constitutional view showing a developing device according to the first embodiment of the invention.

Inside the developing unit main body 40, as shown in FIGS. 4 and 5, a long developing roll 41 is provided at an opening of the developing unit main body 40 and is laid in the direction perpendicular to the paper surface, and spiral augers 42 and 43 as the two developer agitating and transporting members positioned at the back side of the developing roll 41 and laid parallel to the developing roll 41. When the developing roll 41 is rotated, the spiral auger 42 transports a developer 44 contained in the developing unit main body 40 in one direction perpendicular to the paper surface under agitation. On the other hand, the spiral auger 43 transports the developer 44 in the opposite direction to the transporting direction of the spiral auger 42 under agitation, so as to uniformly supply the developer 44 to the developing roll 41.

The developing roll 41 attracts the carrier contained in the developer 44 with magnetic force by a magnet roll not shown in the figure contained inside the developer roll 41, to form a magnetic brush of the developer 44 on the surface of the developer roll 41, so as to transport the toner adsorbed on the carrier to the developing region facing the photoreceptor drum 1. The electrostatic latent image formed on the photoreceptor drum 1 is elicited with the magnetic brush of the developer 44 containing the carrier and the toner formed on the surface of the developing roll 41.

That is, the developer cartridge 50 contains, as shown in FIG. 1, a cylindrical container that is long in the direction perpendicular to the paper surface, and a fresh developer is contained in the developer cartridge 50. In the container for the fresh developer, a supplying port is provided as described later, and the supplying port, as shown in FIG. 4, is connected to a casing 51 having a substantially cylindrical shape for introducing the fresh developer to the developing unit main body 40. The cylindrical casing 51 is provided on an upper part of the back side of the developing unit main body 40. A spiral auger not shown in the figure is provided inside the casing 51, and the developer 44 supplied from the developer cartridge 50 is introduced by the spiral auger to the supplying port 53 provided on the upper face of the back side of the developing unit main body 40, and then supplied to the interior of the developing unit main body 40. On an outlet positioned at the lower end of the supplying port 53 of the developing unit main body 40, a flap not shown in the figure is provided as freely opened and closed.

In the toner cartridge of this embodiment containing the toner containing at least the binder resin, the colorant and the wax in the interior of the toner cartridge main body and a toner agitating and transporting member for supplying the toner from the interior of the toner cartridge under agitation and transportation, the toner contains the wax in an amount of from 3 to 10% by weight and has a toner mean particle diameter of from 3 to 10 $\mu$m, and the toner agitating and transporting member is provided inside the toner cartridge as freely rotatable to form a distance between the agitating and transporting member the toner cartridge main body of from 0.5 to 3.0 mm.

In this embodiment, the developer cartridge 50 containing the developer 64 formed by mixing the toner and the carrier is used as the toner cartridge. However, a toner cartridge containing only a toner may also be used.

As the toner of the developer 64 contained in the developer cartridge 50, a toner containing at least a binder resin, a colorant and wax is used, and the toner contains the wax in an amount of from 3 to 10% by weight and has a mean particle diameter of from 3 to 10 $\mu$m.

Figure 6:
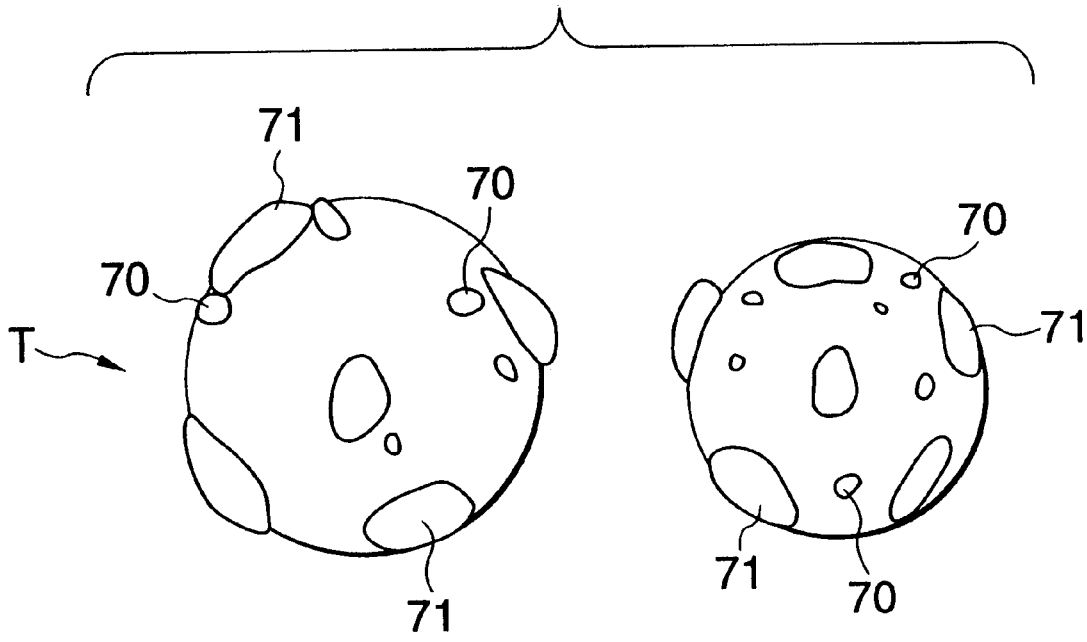
FIG. 6 is a schematic diagrammatic view showing the toner according to the first embodiment of the invention.

In this embodiment, the toner T contains inorganic fine particles 70 in an amount of from 1 to 10% by weight. While the inorganic fine particles 70 are not externally added to the toner T but internally contained in the toner T, a part of the inorganic fine particles 70 is exposed on the surface of the toner T, as shown in FIG. 6. In FIG. 6, numeral 71 denotes the wax contained in the toner T.

The constitution of the developer cartridge 50 will be described with reference to FIG. 1.

As shown in FIG. 1, the developer cartridge 50 has a container case 61 as a cylindrical long cartridge main body containing a fresh developer 64, a cap 62 as a cap member sealing one end thereof provided as detachable, a supplying port 63 as an inlet of a path for supplying the fresh developer 64 from the container case 61 to the developing unit main body 40 of the developing unit, and an agitator 65 as a toner agitating and transporting member for supplying the toner under agitation and transportation from the interior of the container case 61. As the agitator 65, for example, a metallic material, such as a stainless steel wire, is used, which is worked into a spiral shape for agitation and transportation of the developer 64 containing the toner. The agitator 65 is formed with a straight part 65*a* extended at the center of the container case 61 in the axis direction and a spiral part 65*b* provided in a spiral form in the outer periphery of the straight part 65*a*.

Figure 2:
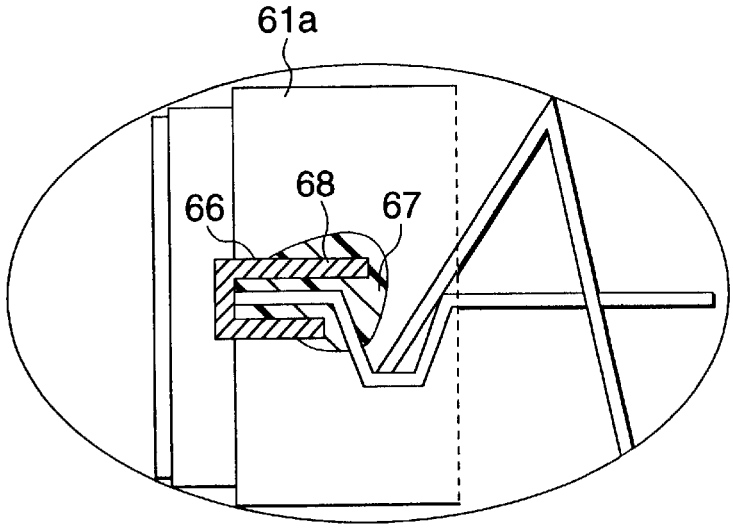
FIG. 2 is a cross sectional constitutional view showing an important part of the developer cartridge according to the first embodiment of the invention.

As shown in FIG. 1 the agitator 65 is supported at one end thereof as freely rotatable by the cap 62 of the developer cartridge 50, and is supported at the other end thereof as freely rotatable by a side wall 61*a* of the back side of the container case 61 via a bearing material 66. In a concave part 67 of the bearing material 66 supporting the end of the agitator 65, as shown in FIG. 2, a curable resin, such as Sealant (a trade name), is filled to seal and cure the concave part, whereby the accumulation of the toner in the concave part 67 is prevented to reduce the mechanical stress applied to the toner, and the toner aggregates are difficult to be formed. Thus, the defects on the resulting image due to the toner aggregates are reduced.

In this embodiment, the agitator 65 is arranged as freely rotatable inside the container case 61 to form a distance (gap) A between the outer periphery and the inner wall of the container case 61 of from 0.5 to 3.0 mm.

EXAMPLE 1

The invention will be further described with reference to the following Example 1, but the invention is not construed as being limited thereto.

EXAMPLE 1-1

| 1-1 Preparation of Toner | |
|---|---|
| Linear polyester resin (linear polyester obtained from terephthalic acid, bisphenol A ethylene oxide adduct and cyclohexane dimethanol, Tg (glass transition point): 65° C., Tm (melting point): 112° C., Mn: 5,000, Mw: 30,000) | 100 parts by weight |
| Magenta pigment (C.I. Pigment Red 57:1) | 6 parts by weight |
| Carnauba wax (melting point: 81° C., melt viscosity at 120° C.: 30 centipoise, endothermic starting temperature: 50° C.) | 7 parts by weight |

The components described in the foregoing are kneaded in an extruder and pulverized by a jet mill, followed by being classified with wind force, so as to obtain colored particles having a volume average particle diameter of 7.5 $\mu$m. 1 part of titania (rutile type having a diameter of 20 nm treated with 16 parts of decyltrimethoxysilane) and 1 part of silica (specific surface area before treatment: 50 $m^2/g$, dimethyl silicone oil, 100 cs) are added to the particles, followed by mixing in a Henschel mixer, so as to obtain a toner.

| 1-2 Preparation of Carrier and Developer | |
|---|---|
| Ferrite particles (Cu-Zn ferrite, average particle diameter: 35 $\mu$m) | 100 parts by weight |
| Toluene | 20 parts by weight |
| Fluorine-containing acrylic resin (Mn: 15,000, Mw: 45,000) | 3.2 parts by weight |
| Carbon black (average particle diameter: 30 nm, VXC72, a trade name, produced by Cabot Inc.) | 0.44 part by weight |
| Melamine resin fine particles | 0.3 part by weight |

The components described in the foregoing other than the ferrite particles are dispersed in a sandmill to produce a coating layer forming liquid. The coating layer forming liquid and the ferrite particles are placed in a vacuum defoaming kneader, and are stirred at 60° C. for 30 minutes, followed by removing the solvent, so as to obtain a carrier.

1-3 Preparation of Developer

The developer 64 is prepared to have a toner concentration of 8 parts by weight using a V blender.

1-4 Preparation of Developer Cartridge

As shown in FIG. 1, a cylindrical developer cartridge 50 having inside an agitator 65 for agitating and transporting the toner is produced with an ABS resin, and the distance A between the agitator 65 and the inner wall is 2.0 mm.

160 g of the developer is filled in the developer cartridge 50.

EXAMPLE 1-2

The same procedures are repeated as in Example 1-1 except that the distance A between the agitator 65 and the inner wall is 0.5 mm.

EXAMPLE 1-3

The same procedures are repeated as in Example 1-1 except that the distance A between the agitator 65 and the inner wall is 3.0 mm.

EXAMPLE 1-4

The same procedures are repeated as in Example 1-1 except that 3 parts by weight of silica ($SiO_2$) are contained as the inorganic fine particles upon kneading.

EXAMPLE 1-5

The same procedures are repeated as in Example 1-1 except that a sealant 68 (single liquid type silicone rubber series sealing material) is applied to a concave part 67 of the agitator supporting part inside the developer cartridge 50 as shown in FIG. 2.

EXAMPLE 1-6

The same procedures are repeated as in Example 1-1 except that 1 part by weight of silica ($SiO_2$) is contained as the inorganic fine particles upon kneading.

EXAMPLE 1-7

The same procedures are repeated as in Example 1-1 except that 7 parts by weight of silica ($SiO_2$) are contained as the inorganic fine particles upon kneading.

EXAMPLE 1-8

The same procedures are repeated as in Example 1-1 except that 10 parts by weight of silica ($SiO_2$) are contained as the inorganic fine particles upon kneading.

EXAMPLE 1-9

The same procedures are repeated as in Example 1-1 except that 0.5 part by weight of silica ($SiO_2$) is contained as the inorganic fine particles upon kneading.

Comparative Example 1-1

The same procedures are repeated as in Example 1-1 except that the distance A between the agitator 65 and the inner wall is 0.3 mm.

Comparative Example 1-2

The same procedures are repeated as in Example 1-1 except that the distance A between the agitator 65 and the inner wall is 3.5 mm.

Comparative Example 1-3

The same procedures are repeated as in Example 1-1 except that 12 parts by weight of silica ($SiO_2$) are contained as the inorganic fine particles upon kneading.

Evaluation

The developer cartridges 50 of Examples 1-1 to 1-9 and Comparative Examples 1-1 to 1-3 are allowed to stand for 1 month after installation of the toner, and subjected to a printing test of 1,000 sheets of A4 paper in a modified machine of CLW3330 produced by Fuji Xerox Co., Ltd. The test is conduced under the conditions of 28° C. and 85%.

For the evaluation of color spots and discolored spots, the number of occurrence is counted per 200 sheets after printing an image of an image area ratio of 100% on A3 paper. With respect to the color spots, occurrence of 5 color spots is classified to the allowable level while depending on the size of the color spot, and the number of color spots more than 5 is classified to the unallowable level.

The evaluation of color lines is conducted by printing an image of an image area ratio of 50% on A3 paper, and evaluating 10 sheets per 200 sheets for the four grades of from G1 (good) to G4 (poor). The grades of G3 and G4 are classified to the unallowable level.

When the toner agitating and transporting property of the intended purpose of the agitator inside the cartridge becomes poor, the toner remaining amount becomes large, 5 g or less of which is the allowable level.

The evaluation results of Examples and Comparative Examples are shown in Table 1. It is understood that an excellent image quality can be provided by using the toner and the developer cartridge of Examples.

TABLE 1

| | Distance to inner-wall A (mm) | Content of silica (% by weight) | Presence of sealant | Number of color spot and discolored spot | Grade of color lines | Fixing property | Toner remaining amount (g) | Total evaluation |
|---|---|---|---|---|---|---|---|---|
| Example 1 | 2.0 | 0.0 | none | 4 | G2 | B | 4 | B |
| Example 2 | 0.5 | 0.0 | none | 5 | G2 | B | 3 | B |
| Example 3 | 3.0 | 0.0 | none | 4 | G2 | B | 5 | B |
| Example 4 | 2.0 | 3.0 | none | 2 | G1 | B | 4 | A |
| Example 5 | 2.0 | 0.0 | present | 2 | G2 | B | 4 | A |
| Example 6 | 2.0 | 1.0 | none | 3 | G2 | B | 4 | B |
| Example 7 | 2.0 | 7.0 | none | 1 | G1 | B | 4 | B |
| Example 8 | 2.0 | 10.0 | none | 0 | G1 | B | 4 | B |
| Example 9 | 2.0 | 0.5 | none | 4 | G2 | B | 4 | B |
| Comparative Example 1 | 0.3 | 0.0 | none | >30 | G2 | B | 3 | C |
| Comparative Example 2 | 3.5 | 0.0 | none | 4 | G4 | B | 6 | C |
| Comparative Example 3 | 2.0 | 12.0 | none | 0 | G1 | C | 4 | C |

Total Evaluation

Evaluation Grades

A: sufficient in color spots and discolored spots, color lines, fixing property and toner remaining amount B: allowable in color spots and discolored spots, color lines, fixing property and toner remaining amount C: unallowable in color spots and discolored spots, color lines, fixing property and toner remaining amount It is understood from the results in Table 1 that in Examples 1-4 and 1-5, the number of color spots and discolored spots caused by formation of the toner aggregates is small and the grade for color line and the fixing property is also good. Examples 1-7 and 1-8 are relatively good but are slightly poor in fixing property because the content of the silica is relatively large.

Second Embodiment

FIGS. 4 and 5 show the second embodiment of the invention, in which the same symbols are attached to the same parts as in the first embodiment. In the developing device of the second embodiment containing a toner containing at least a binder resin, a colorant and wax in the interior of a main body of the developing device, and having a toner agitating and transporting member for agitating and transporting the toner contained inside the main body of the developing device, in which the toner is transported to a developer holding member by the toner agitating and transporting member to develop an electrostatic latent image formed on an image holding member with the toner carried on the surface of the developer holding member, the toner contains wax in an amount of from 3 to 10% by weight and has a mean particle diameter of from 3 to 10 $\mu$m, and the toner agitating and transporting member is arranged as freely rotatable inside the main body of the developing device to form a distance between the member and the inner wall of the developing device of from 0.5 to 3.0 mm.

In the second embodiment, the toner may contain inorganic fine particles in an amount of from 1 to 10% by weight.

In this embodiment, as shown in FIGS. 4 and 5, two spiral augers 42 and 43 are arranged as the developer agitating and transporting member for agitating and transporting the developer contained inside the developing device main body 40 of a developing device 5, and the two spiral augers 42 and 43 are arranged inside the developing device main body 40 as freely rotatable to form a distance (gap) to the inner wall 40*a* of the developing device main body 40 of from 0.5 to 3.0 mm.

The toner in the developer 44 contained in the developing device main body 40 contains at least a binder resin, a colorant and wax, and the toner contains the wax in an amount of from 3 to 10% by weight and has a mean particle diameter of from 3 to 10 $\mu$m.

In this embodiment, the toner T contains inorganic fine particles 70 in an amount of from 1 to 10% by weight. While the inorganic fine particles 70 are not externally added to the toner T but internally contained in the toner T, a part of the inorganic fine particles 70 are exposed on the surface of the toner T, as shown in FIG. 6. In FIG. 6, numeral 71 denotes the wax contained in the toner T.

EXAMPLE 2

The invention will be further described with reference to the following Example 2, but the invention is not construed as being limited thereto.

EXAMPLE 2-1

| 2-1 Preparation of Toner | |
|---|---|
| Linear polyester resin (linear polyester obtained from terephthalic acid, bisphenol A ethylene oxide adduct and cyclohexane dimethanol, Tg (glass transition point): 65° C., Tm (melting point): 112° C., Mn: 5,000, Mw: 30,000) | 100 parts by weight |
| Magenta pigment (C.I. Pigment Red 57:1) | 6 parts by weight |
| Carnauba wax (melting point: 81° C., molten viscosity at 120° C.: 30 centipoise, endothermic starting temperature: 50° C.) | 7 parts by weight |

The components described in the foregoing are kneaded in an extruder and pulverized by a jet mill, followed by being classified with wind force, so as to obtain colored particles having a volume average particle diameter of 7.5 $\mu$m. 1 part of titania (rutile type having a diameter of 20 nm treated with 16 parts of decyltrimethoxysilane) and 1 part of silica (specific surface area before treatment: 50 $m^2/g$ , dimethyl silicone oil, 100 cs ) are added to the particles, followed by mixing in a Henschel mixer, so as to obtain a toner.

| 2-2 Preparation of Carrier and Developer | |
|---|---|
| Ferrite particles (Cu-Zn ferrite, average particle diameter: 35 $\mu$m) | 100 parts by weight |
| Toluene | 20 parts by weight |
| Fluorine-containing acrylic resin (Mn: 15,000, Mw: 45,000) | 3.2 parts by weight |
| Carbon black (average particle diameter: 30 nm, VXC72, a trade name, produced by Cabot Inc.) | 0.44 part by weight |
| Melamine resin fine particles | 0.3 part by weight |

The components described in the foregoing other than the ferrite particles are dispersed in a sandmill to produce a coating layer forming liquid. The coating layer forming liquid and the ferrite particles are placed in a vacuum defoaming kneader, and are stirred at 60° C. for 30 minutes, followed by removing the solvent, so as to obtain a carrier.

2-3 Preparation of Developer

The developer 44 is prepared to have a toner concentration of 8 parts by weight using a V blender.

2-4 Preparation of Developing Device

As shown in FIG. 4, the developing device 5 having inside augers 42 and 43 for agitating and transporting is prepared, in which the distance A between the augers 42 and 43 and the inner wall is 2.0 mm.

270 g of the developer is filled in the developing device main body 40.

EXAMPLE 2-2

The same procedures are repeated as in Example 2-1 except that the distance A between the augers 42 and 43 and the inner wall is 0.5 mm.

EXAMPLE 2-3

The same procedures are repeated as in Example 2-1 except that the distance A between the augers 42 and 43 and the inner wall is 3.0 mm.

EXAMPLE 2-4

The same procedures are repeated as in Example 2-1 except that 3 parts by weight of silica ($SiO_2$) are contained as the inorganic fine particles upon kneading.

EXAMPLE 2-5

The same procedures are repeated as in Example 2-1 except that 1 part by weight of silica ($SiO_2$) is contained as the inorganic fine particles upon kneading.

EXAMPLE 2-6

The same procedures are repeated as in Example 2-1 except that 7 parts by weight of silica ($SiO_2$) are contained as the inorganic fine particles upon kneading.

EXAMPLE 2-7

The same procedures are repeated as in Example 2-1 except that 10 parts by weight of silica ($SiO_2$) are contained as the inorganic fine particles upon kneading.

EXAMPLE 2-8

The same procedures are repeated as in Example 2-1 except that 0.5 part by weight of silica ($SiO_2$) is contained as the inorganic fine particles upon kneading.

Comparative Example 2-1

The same procedures are repeated as in Example 2-1 except that the distance A between the augers 42 and 43 and the inner wall is 0.3 mm.

Comparative Example 2-2

The same procedures are repeated as in Example 2-1 except that the distance A between the augers 42 and 43 and the inner wall is 3.5 mm.

Comparative Example 2-3

The same procedures are repeated as in Example 2-1 except that 12 parts by weight of silica ($SiO_2$) are contained as the inorganic fine particles upon kneading.

Evaluation

The developing devices of Examples 2-1 to 2-8 and Comparative Examples 2-1 to 2-3 are allowed to stand for 1 month after installation of the developer, and subjected to a printing test of 1,000 sheets of A4 paper in a modified machine of CLW3330 produced by Fuji Xerox Co., Ltd. The test is conduced under the conditions of 28° C. and 85%.

For the evaluation of color spots and discolored spots, the number of occurrence is counted per 200 sheets after printing an image of an image area ratio of 100% on A3 paper. With respect to the color spots, occurrence of 5 color spots is classified to the allowable level while depending on the size of the color spot, and the number of color spots more than 5 is classified to the unallowable level.

The evaluation of color lines is conducted by printing an image of an image area ratio of 50% on A3 paper, and evaluating 10 sheets per 200 sheets for the four grades of from G1 (good) to G4 (poor). The grades of G3 and G4 are classified to the unallowable level.

The evaluation results of Examples and Comparative Examples are shown in Table 2. It is understood that an excellent image quality can be provided by using the developing device of Examples.

TABLE 2

| | Distance to inner-wall A (mm) | Content of silica (% by weight) | Number of color spot and discolored spot | Grade of color lines | Fixing property | Total evaluation |
|---|---|---|---|---|---|---|
| Example 1 | 2.0 | 0.0 | 4 | G2 | B | B |
| Example 2 | 0.5 | 0.0 | 5 | G2 | B | B |
| Example 3 | 3.0 | 0.0 | 4 | G2 | B | B |
| Example 4 | 2.0 | 3.0 | 2 | G1 | B | A |
| Example 5 | 2.0 | 1.0 | 3 | G2 | B | B |
| Example 6 | 2.0 | 7.0 | 1 | G1 | B | B |
| Example 7 | 2.0 | 10.0 | 0 | G1 | B | B |
| Example 8 | 2.0 | 0.5 | 4 | G2 | B | B |
| Comparative Example 1 | 0.3 | 0.0 | >30 | G2 | B | C |
| Comparative Example 2 | 3.5 | 0.0 | 4 | G4 | B | C |
| Comparative Example 3 | 2.0 | 12.0 | 0 | G1 | C | C |

Total Evaluation

Evaluation Grades

A: sufficient in color spots and discolored spots, color lines, fixing property and toner remaining amount B: allowable in color spots and discolored spots, color lines, fixing property and toner remaining amount C: unallowable in color spots and discolored spots, color lines, fixing property and toner remaining amount The other constitutions and functions of this embodiment are the same as those in the first embodiment, and therefore the detailed descriptions thereof are omitted.

As described in the foregoing, the invention provides a toner, a toner cartridge and a developing device using the same in that an excellent image without a defect on the image is obtained in a long period of time, and stable agitation and transportation can be conducted.

What is claimed is:

1. A toner cartridge comprising a toner and a toner agitating and transporting member for supplying the toner under agitation and transportation from inside the toner cartridge, the toner having a binder resin, a colorant and a wax, the wax is in an amount of from 1 to 15% by weight of the toner and the toner having a mean particle diameter of from 3 to 10 $\mu$m, and the toner agitating and transporting member being arranged as rotatably inside the toner cartridge to form a distance of from 0.5 to 3.0 mm between the toner agitating and transporting member and an inner wall of a main body of the toner cartridge.

2. A toner cartridge as claimed in claim 1, wherein the wax has an endothermic starting temperature of 40° C. or more.

3. A toner cartridge as claimed in claim 1, wherein the wax has a melting point of from 70 to 120° C.

4. A toner cartridge as claimed in claim 1, wherein the wax has a melt viscosity of from 1 to 200 centipoise at 120° C.

5. A toner cartridge as claimed in claim 1, wherein the toner further contains inorganic fine particles in an amount of from 1 to 10% by weight.

6. A toner cartridge as claimed in claim 1, wherein the toner is a color toner.

7. A toner cartridge as claimed in claim 1, wherein the toner agitating and transporting member is supported at both ends thereof by the main body of the toner cartridge.

8. A developing unit comprising a toner, a toner cartridge and a developing device for developing an electrostatic latent image by the toner on the surface of a developer holding member, the toner having a binder resin, a colorant and a wax, wherein the wax is in an amount of from 3 to 10% by weight and the toner having a mean particle diameter of from 3 to 10 $\mu$m, and the toner cartridge comprising the toner and a toner agitating and transporting member for supplying the toner under agitation and transportation from inside the toner cartridge to the developing device, the toner agitating and transporting member being arranged as rotatably inside the toner cartridge to form a distance of from 0.5 to 3.0 mm between the toner agitating and transporting member and an inner wall of the toner cartridge.

9. A developing unit as claimed in claim 8, wherein the toner further contains inorganic fine particles in an amount of from 1 to 10% by weight.

10. A developing unit as claimed in claim 8, wherein the wax has an endothermic starting temperature of 40° C. or more.

11. A developing unit as claimed in claim 8, wherein the wax has a melting point of from 70 to 120° C.

12. A developing unit as claimed in claim 8, wherein the wax has a melt viscosity of from 1 to 200 centipoise at 120° C.

13. A developing unit as claimed in claim 8, wherein the toner is a color toner.

14. A developing unit as claimed in claim 8, wherein the toner agitating and transporting member is supported at both ends thereof by the developing device.

15. A process for producing an image with the developing device according to claim 8, comprising transporting the toner inside the main body of the developing device to the developer holding member where the toner on the surface of the developer holding member develops the electrostatic latent image formed on an image holding member, and subsequently transferring the developed image to a recording medium.

16. A process for producing an image as claimed in claim 15, wherein the toner further contains inorganic fine particles in an amount of from 1 to 10% by weight.

17. A process for producing an image as claimed in claim 15, wherein the wax has an endothermic starting temperature of 40° C. or more.

18. A process for producing an image as claimed in claim 15, wherein the wax has a melting point of from 70 to 120° C.

19. A process for producing an image as claimed in claim 15, wherein the process for forming an image is a process for forming a full color image.

20. A process for producing an image as claimed in claim 15, wherein the toner agitating and transporting member is supported at both ends thereof by the developing device.

* * * * *